US012522459B2

(12) United States Patent
Tokuma

(10) Patent No.: US 12,522,459 B2
(45) Date of Patent: Jan. 13, 2026

(54) SHEET CONVEYING APPARATUS AND IMAGE FORMING APPARATUS

(71) Applicant: CANON KABUSHIKI KAISHA, Tokyo (JP)

(72) Inventor: Naoto Tokuma, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/743,222

(22) Filed: Jun. 14, 2024

(65) Prior Publication Data

US 2025/0019194 A1 Jan. 16, 2025

(30) Foreign Application Priority Data

Jul. 14, 2023 (JP) ..... 2023-115645

(51) Int. Cl.
*B65H 9/00* (2006.01)
*B65H 5/06* (2006.01)
*B65H 7/02* (2006.01)

(52) U.S. Cl.
CPC ..... *B65H 9/006* (2013.01); *B65H 5/068* (2013.01); *B65H 7/02* (2013.01); *B65H 9/004* (2013.01)

(58) Field of Classification Search
CPC ..... B65H 9/004; B65H 9/006; B65H 7/02; B65H 7/14; B65H 7/20; B65H 2301/142; B65H 2301/13; G03G 15/6567
See application file for complete search history.

(56) References Cited

U.S. PATENT DOCUMENTS

| | | | | |
|---|---|---|---|---|
| 8,348,266 | B2 * | 1/2013 | Deno | B65H 9/06 271/245 |
| 8,770,581 | B2 * | 7/2014 | Deno | B65H 9/002 271/228 |
| 9,102,485 | B2 | 8/2015 | Deno | |
| 9,242,821 | B2 * | 1/2016 | Watanabe | B65H 5/062 |
| 11,724,899 | B2 * | 8/2023 | Takane | B65H 5/062 271/226 |
| 12,246,941 | B2 * | 3/2025 | Ishioka | B65H 9/006 |

FOREIGN PATENT DOCUMENTS

JP 2015078029 A 4/2015

* cited by examiner

*Primary Examiner* — Ernesto A Suarez
(74) *Attorney, Agent, or Firm* — ROSSI, KIMMS & McDOWELL LLP

(57) ABSTRACT

A sheet conveying apparatus that has a first conveying roller pair, and a second conveying roller pair, and corrects skew feeding of a sheet by a tip of the sheet abutting against a nip portion of the first conveying roller pair, including: a conveying unit that can shift and has a third conveying roller provided between the first conveying roller pair and the second conveying roller pair, wherein when a first sheet is conveyed, a tip of the first sheet is guided with the third conveying roller located in an abutting position where the third conveying roller abuts on a counter roller, and wherein when a second sheet with a basis weight greater than that of the first sheet, a tip of the second sheet is guided with the third conveying roller located in the separating position where the third conveying roller is separated from the counter roller.

7 Claims, 9 Drawing Sheets

SHEET CONVEYING APPARATUS AND IMAGE FORMING APPARATUS

BACKGROUND OF THE INVENTION

Field of the Invention

This invention relates to a sheet conveying apparatus and an image forming apparatus having the sheet conveying apparatus.

Description of the Related Art

Conventionally, in a sheet conveying apparatus used in an image forming apparatus for forming an image on a sheet, the technique for correcting shew feeding of a sheet by the sheet tip abutting to the nip portion of the conveying roller pair to form a loop on the sheet is known (Japanese Patent Application Laid-open No. 2015-78029). The technique is generally used for securing a space for making a loop on a sheet whose skew feeding should be corrected by separating an upstream roller pair and an upstream guide disposed upstream of the conveying roller pair in the conveying direction.

However, in the case where the skew feeding of a sheet is corrected by the tip of a sheet abutting to the nip portion of the conveying roller pair, when the abutting force is too weak, the correction of the skew feeing of a sheet is insufficiently performed. In contrast, the abutting force is too strong, a problem occurs such as an edge curl-up, which is a curl-up of the sheet edge portion which curls up when the sheet edge portion abuts to the nip portion and a slip mark, which is produced when the reactive force of the sheet is greater than the conveying force of the upstream rollers.

Recently, it is required to deal with various kinds of sheets from thin sheets to thick sheets.

When skew feeding of a thin sheet is corrected by the tip portion of the thin sheet abutting to the nip portion of the conveying roller pair, an edge curl-up of the tip of the sheet is easy to occur. To avoid an edge curl-up from occurring, guide portions with a jump ramp shape are often formed at the upstream guide. When guide portions with a jump ramp shape are formed at the upstream guide, the gap between the guide portions opposed to each other via the sheet becomes small at the guide portions with a jump ramp shape. Therefore, generally the guide portions with a jump ramp shape are not formed in the entire region in the width direction perpendicular to the sheet conveying direction, but partially formed.

In contrast, when skew feeding of a thick sheet is corrected by the tip portion of the thick sheet abutting to the nip portion of the conveying roller pair, the abutting pressure of the sheet to the upstream guide at the guide portions with a jump ramp shape is higher than at the other portions. As a result, the sheet is strongly rubbed with the guide portions with a jump ramp shape of the upstream guide (galvanized steel plate) so that adherence of the galvanized steel plate to the sheet (black mark) may occur.

It could be considered for avoiding an edge curl-up and a black mark to accept a thin sheet and a thick sheet by separating the upstream rollers and the upstream guides without forming a jump ramp shape on the conveying guides. However, when accepting a thin sheet separating the upstream rollers and the upstream guides, the loop space of the sheet becomes larger and the abutting force of the tip of the sheet becomes weak. In this case, the skew feeding of the sheet may be insufficiently corrected.

SUMMARY OF THE INVENTION

A representative configuration of the present invention is a sheet conveying apparatus having a first conveying roller pair configured to nip and convey a sheet, and a second conveying roller pair provided upstream of the first conveying roller pair in a sheet conveying direction, the second conveying roller pair being configured to nip and convey the sheet, the sheet conveying apparatus being configured to correct skew feeding of the sheet by a tip of the sheet abutting against a nip portion of the first conveying roller pair, the sheet conveying apparatus comprising:

a conveying unit having a third conveying roller that conveys the sheet, and a guide member that guides the sheet, the third conveying roller being provided between the first conveying roller pair and the second conveying roller pair, the guide member being configured to support the third conveying roller and to be rotatable, the conveying unit being configured to shift along with the guide member to an abutting position where the third conveying roller abuts on a counter roller or a separating position where the third conveying roller is separated from the counter roller;

a driving portion configured to switch a position of the conveying unit to the abutting position and the separating position;

a detecting member configured to detect the position of the conveying unit; and a control portion configured to switch the position of the conveying unit according to a basis weight of the sheet, wherein when a first sheet with a predetermined basis weight is conveyed, the control portion performs such a control that the third conveying roller is located in the abutting position and a tip of the first sheet is guided along the guide member to a nip portion between the third conveying roller and the counter roller with the third conveying roller being located in the abutting position, and wherein when a second sheet with a basis weight greater than that of the first sheet, the control portion performs such a control that the third conveying roller is located in the separating position and a tip of the second sheet is guided along the guide member with the third conveying roller being located in the separating position.

Further features of the present invention will become apparent from the following description of exemplary embodiments with reference to the attached drawings.

DESCRIPTION OF THE EMBODIMENTS

Hereinafter, with reference to the drawings, preferable embodiments of the present invention will be described in detail. However, the dimensions, materials, shapes, and relative arrangement of the components described in the following embodiments should be changed as appropriate depending on the configuration and various conditions of the apparatus to which the invention is applied, and it is not intended to limit the scope of the invention to them alone.

Figure 1:
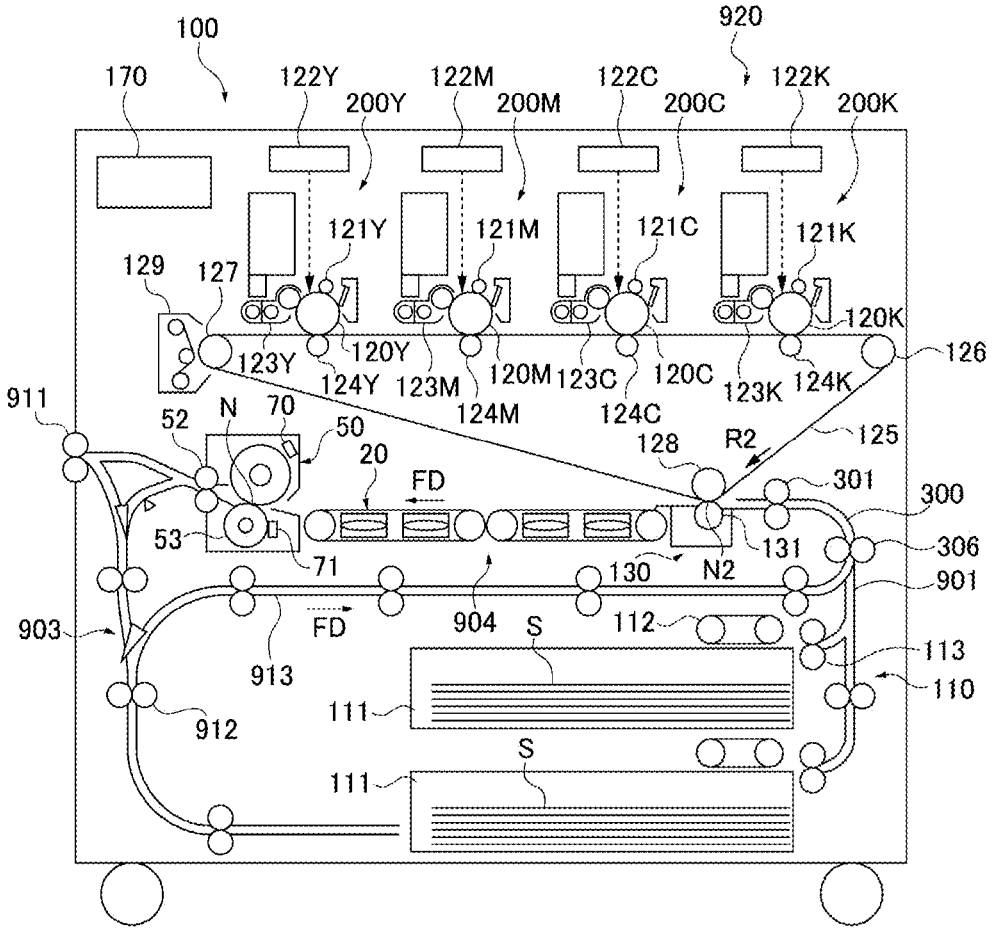
FIG. 1 is a schematic diagram showing the configuration of an image forming apparatus according to an embodiment of the present invention.

FIG. 1 is a schematic diagram showing the configuration of the image forming apparatus 100. First, the configuration of the image forming apparatus 100 will be described referring to FIG. 1. The image forming apparatus 100 has the feeding portion 110 that feeds a sheet, the image forming portion 920 that forms a toner image to be fixed to the sheet fed by the feeding portion 110, the belt conveying unit 904 that conveys to the fixing portion 50 the sheet on which a toner image has been transferred, and the post conveying portion 903 that conveys the sheet to which a toner image has been fixed by the fixing portion 50.

The feeding portion 110 has the sheet cassette 111 that accommodates sheets, the pickup roller 112 that picks up a sheet from the sheet cassette 111, the separating device 113 that separates and feeds a sheet picked up by the pickup roller 112.

The feeding portion 110 further has the registration unit 300 as a sheet conveying apparatus. The registration unit 300 has the registration rollers 301 as a first conveying roller pair that nips and conveys a sheet, the vertical path rollers 306 that nips and conveys a sheet, provided as a second conveying roller pair upstream of the registration rollers 301 in the conveying direction. The registration unit 300 conveys a sheet using the vertical path rollers 306 in the conveying path 901 and abuts the tip of the sheet on the nip portion of the registration rollers 301 to correct the skew feeding of the sheet. In the conveying path 901, the sheet separated by the separating device 113 is conveyed.

The image forming portion 920 is of a tandem type and has the electrophotographic type image forming stations 200Y, 200M, 200C, and 200K disposed in series. The image forming stations 200Y, 200M, 200C, and 200K respectively form toner images of yellow (Y), magenta (M), cyan (C), and black (B). The configurations of the image forming stations 200Y, 200M, 200C and 200K are the same as each other except for the colors of toner. Therefore, the configuration of the image forming station 200Y is taken as an example and the description of those of the other image forming stations 200M, 200C and 200K is omitted. In FIG. 1, the suffixes "Y", "M", "C" and "K" are attached to the components of the image forming station 200Y, the components of the image forming station 200M, the components of the image forming station 200C and the components of the image forming station 200C, respectively. The image forming station 200Y has the photosensitive drum 120Y, the primary charging device 121Y, the exposure device 122Y, and the developing device 123Y.

The image forming portion 920 has the intermediate transfer belt 125 as an example of an image bearing member that bears toner images visualized by the image forming stations 200Y, 200M, 200C and 200K. The intermediate transfer belt 125 is wound around and supported by the driving roller 126, the tension roller 127 and the transfer inner roller 128. The intermediate transfer belt 125 is driven to rotate in the direction of arrow R2 in FIG. 1 by the driving roller 126.

The secondary transfer roller 131 presses the intermediate transfer belt 125 supported from the inner side of the intermediate transfer belt 125 by the transfer inner roller 128 to form the secondary transfer nip portion N2 between the secondary transfer roller 131 and the intermediate transfer belt 125. The secondary transfer roller 131, the intermediate transfer belt 125, and the transfer inner roller 128 constitute the secondary transfer portion 130 as a transfer portion in the present embodiment.

The cleaning device 129 rubs a cleaning web on the intermediate transfer belt 125 to remove the residual transfer toner and paper dust remaining on the surface of the intermediate transfer belt 125 after the surface has passed through the secondary transfer nip portion N2.

The fixing portion 50 is disposed downstream of the second transfer portion 130 in the conveying direction FD of the sheet. The fixing portion 50 fixes a toner image to the sheet by heat and pressure. The fixing portion 50 has the heating roller 52 and the pressure roller 53. The heating roller 52 has a heater inside. The pressure roller 53 is disposed to be able to abut on the heating roller 52 and to form a fixing nip portion N together with the heating roller 52. The fixing portion 50 has the heating roller temperature sensor 70 that detects a surface temperature of the heating roller 52 and the pressure roller temperature sensor 71 that detects a surface temperature of the pressure roller 53. The heating roller temperature sensor 70 and the pressure roller temperature sensor 71 are respectively provided to maintain the temperature of the heating roller 52 and the surface temperature of the pressure roller 53 to appropriate temperatures.

In the conveying direction FD of the sheet, the belt conveying unit 904 is disposed between the secondary transfer portion 130 and the fixing portion 50. The belt conveying unit 904 is constituted by the first belt conveying portion 10 disposed upstream and the second belt conveying portion 20 disposed downstream in the conveying direction FD of the sheet.

The post conveying portion 903 has the discharge roller 911 that discharges the sheet discharged from the fixing portion 50 outside the image forming apparatus 100. The post conveying portion 903 further has the reverse roller 912 that reverses and conveys the sheet and the duplex conveying path 913 for conveying the sheet reversed by the reverse roller 912 and bring the sheet to the conveying path 901.

Next, a flow of the procedures of forming an image on a sheet in the image forming apparatus 100 will be described. First, based on an image forming job input to the image forming apparatus 100, the exposure device 122Y exposes the photosensitive drum 120Y with light to form an electrostatic latent image on the surface of the photosensitive drum 120Y. The electrostatic latent image on the photosensitive drum 120Y is developed by the developing device 123Y into a visible image of toner. The toner image borne on the surface of the photosensitive drum 120Y is primarily transferred onto the intermediate transfer belt 125 in a sequentially superimposed manner by the primary transfer device 124Y. The toner image primarily transferred onto the intermediate transfer belt 125 is secondarily transferred onto the sheet S fed from the feeding portion 110 at the secondary transfer nip portion N2.

The registration rollers 301 receive the sheet S in the state in which the rotation of the registration rollers 301 being halted and send the sheet S toward the secondary transfer nip portion N2 in synchronism with the timing of the toner image on the intermediate transfer belt 125. After the toner image is transferred onto the sheet S at the secondary transfer nip portion N2, the sheet S that bears the toner image is conveyed from the secondary transfer nip portion N2 to the fixing portion 50 by the belt conveying unit 904. In the fixing portion 50, the toner image is fixed to the sheet by nipping the sheet S and applying heat and pressure to the unfixed toner image at the fixing nip portion N. The sheet S conveyed out of the fixing portion 50 is discharged outside the image forming apparatus 100 by the discharge roller 911.

An image should be formed on both surfaces of the sheet, the sheet conveyed out of the fixing portion 50 is conveyed to the reverse roller 912. After the sheet is reversed by the reverse roller 912, the sheet is conveyed toward the duplex conveying path 913. Then, the sheet is conveyed to the conveying path 901 via the duplex conveying path 913 and a toner image is formed on the second surface (back surface) of the sheet like the first surface (front surface).

Figure 2:
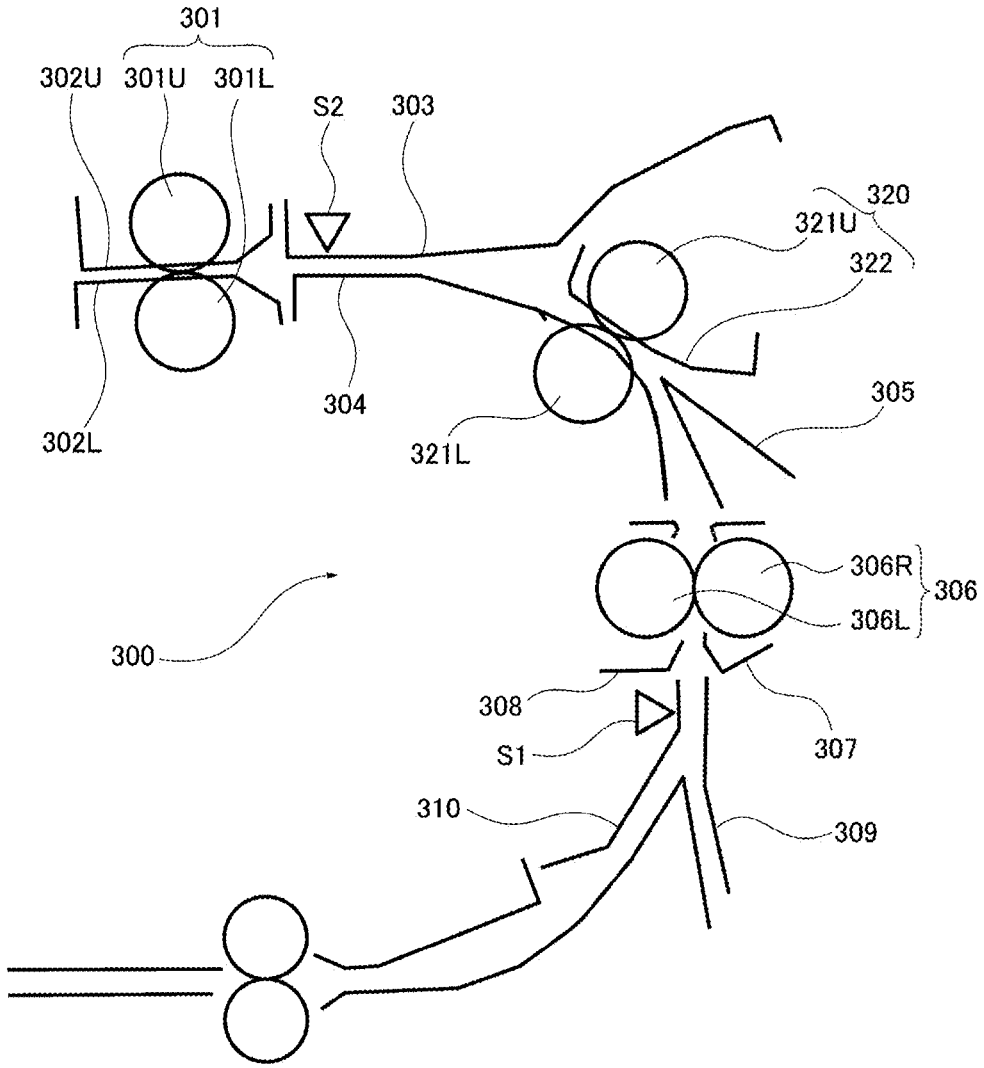
FIG. 2 is a diagram showing a cross-section of a registration unit of the image forming apparatus.

Next, the configuration and the basic operation of the registration unit 300 will be described with reference to FIG. 2. FIG. 2 is a diagram showing a cross-section of the registration unit 300.

Figure 8:
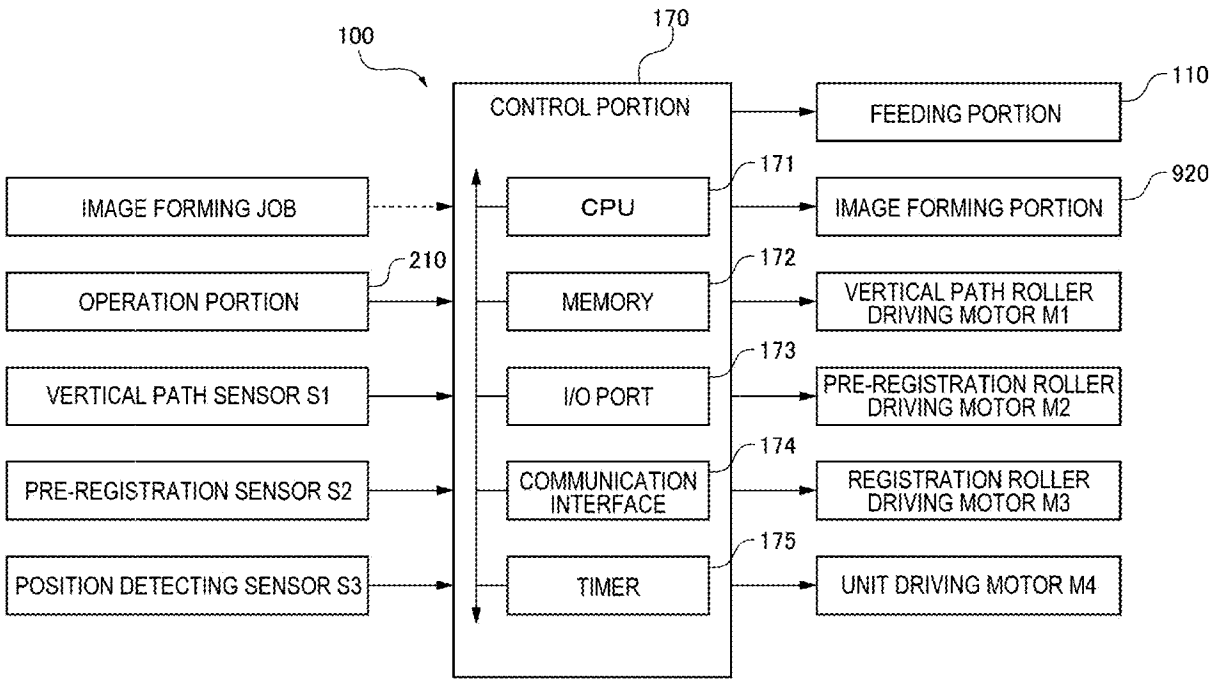
FIG. 8 is a block diagram of the image forming apparatus.

As shown in FIG. 2, the registration unit 300 as a sheet conveying apparatus has the registration rollers 301 as described above. The registration rollers 301 include the upper roller 301U and the lower roller 301L that is opposed to the upper roller 301U. The upper roller 301U and the lower roller 301L constitute a roller pair. The registration rollers 301 are a first conveying roller pair that nips and conveys a sheet with its upper roller U301 and lower roller L301. The registration rollers 301 are driven by the registration roller driving motor M3 (see FIG. 8). The registration roller driving motor M3 is controlled to be driven by the control portion 170 (FIGS. 1 and 8). The registration guides 302U and the 302L that form a conveying path for guiding a sheet are disposed for the registration rollers 301. The pre-registration upper guide 303 and the pre-registration lower guide 304 that form a conveying path for guiding a sheet are disposed upstream of the registration guide 302 in the conveying direction. The pre-registration sensor S2 that detects a sheet is disposed at the pre-registration upper guide 303. The pre-registration sensor S2 is connected to the control portion 170 (see FIGS. 1 and 8) so that the detection signal of the pre-registration sensor S2 is provided to the control portion 170 (see FIGS. 1 and 8). The pre-registration lower guide 304 is a guide member that forms a curved conveying path for guiding a sheet together with the pre-registration guide 322, which will be described later. The pre-registration lower guide 304 is located at the inner side of the curved conveying path.

The registration unit 300 has the conveying guide 305 and the vertical path rollers 306. The conveying guide 305 is disposed between the conveying unit 320, which will be described later and the vertical path rollers 306. The vertical path rollers 306 include the right roller 306R and the left roller 306L that is opposed to the right roller 306R. The right roller 306R and the left roller 306L constitute a roller pair. The vertical path rollers 306 are disposed downstream of the registration rollers 301 and upstream of the pre-registration rollers 321 (, which will be described later) in the conveying direction. The vertical path rollers 306 are a second conveying roller pair that nips and conveys a sheet with its right roller 306R and left roller 306L. The vertical path rollers 306 are driven by the vertical path roller driving motor M1 (see FIG. 8). The vertical path roller driving motor M1 is controlled to be driven by the control portion 170 (see FIGS. 1 and 8). The right vertical path guide 307 and the left vertical path guide 308 that form a conveying path for guiding a sheet are disposed for the vertical path rollers 306. The feeding path guide 309 that guides a sheet and the duplex confluent guide 310 are disposed upstream of the vertical path rollers 306 in the conveying direction. The vertical path sensor S1 that detects a sheet is disposed at the duplex confluent guide 310. The vertical path sensor S1 is connected to the control portion 170 (see FIGS. 1 and 8) so that the detection signal of the vertical path sensor S1 is provided to the control portion 170 (see FIGS. 1 and 8).

The registration unit 300 has the conveying unit 320 with the upper pre-registration roller 321U and the pre-registration guide 322. The conveying unit 320 is provided between the registration rollers 301 and the vertical path rollers 306. The upper pre-registration roller 321U can be switched between the position where the upper pre-registration roller 321U abuts on the lower pre-registration roller 321L and the position where the upper pre-registration roller 321U is separated from the lower pre-registration roller 321L.

The pre-registration rollers 321 constitute a roller pair that nips and conveys a sheet with the upper pre-registration roller 321U and the lower pre-registration roller 321L. The pre-registration rollers 321 are driven by the pre-registration driving motor M2 (see FIG. 8). The pre-registration roller driving motor M2 is controlled to be driven by the control portion 170 (see FIGS. 1 and 8). The upper pre-registration roller 321U is the third conveying roller for conveying a sheet, which is provided between the registration rollers 301 and the vertical path rollers 306. The lower pre-registration roller 321L is a counter roller disposed to be opposed to the upper pre-registration roller 321U. The lower pre-registration roller 321L is disposed at the registration lower guide 304. The pre-registration rollers 321 are disposed upstream of the registration rollers 301 and downstream of the vertical path rollers 306 in the conveying direction.

The pre-registration guide 322 is a supporting member that supports the upper pre-registration roller 321U and is rotatable around the rotation center 320C. The pre-registration guide 322 is a guide member that forms a curved conveying path for guiding a sheet together with the pre-registration lower guide 304 (, which has been described above) in the conveying unit 320. The pre-registration guide 322 is provided outside the curved conveying path.

The pre-registration guide 322 is rotatable integrally with the upper pre-registration roller 321U around the rotation center 320C as the conveying unit 320. The pre-registration guide 322 is driven by the unit driving motor M4 (see FIG. 8). The upper pre-registration roller 321U and the pre-registration guide 322 are integrally rotatable around the rotation center 320C as the conveying unit 320. The upper pre-registration roller 321U is capable of abutting on the lower pre-registration roller 321L and being separated from the lower pre-registration roller 321L.

Figure 3A:
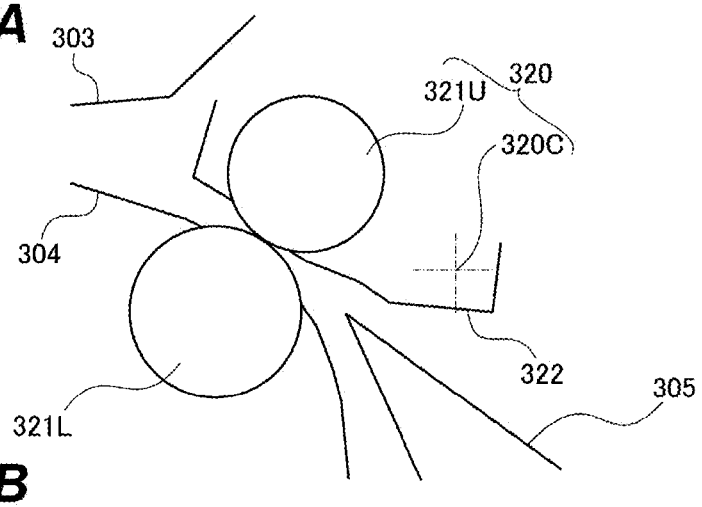
FIGS. 3A, 3B, and 3C are explanatory diagrams showing an abutting operation and a separating operation of the conveying unit.
Figure 3B:
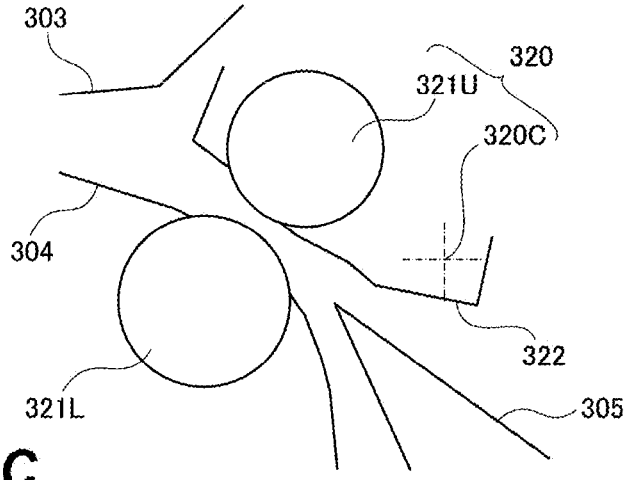
Figure 3C:
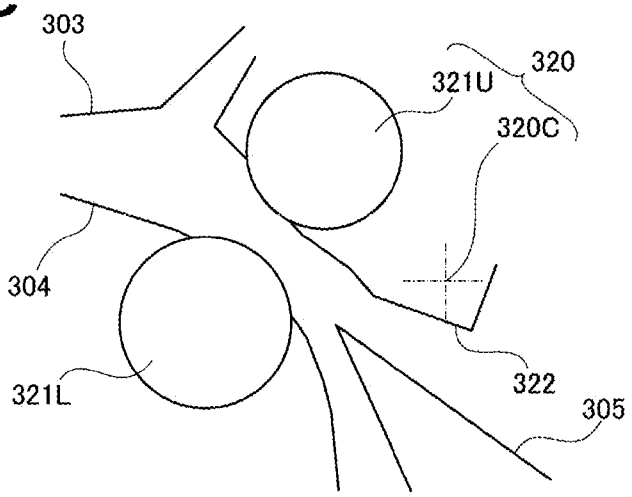

Next, the abutting and separating operation of the conveying unit 320 will be described referring to FIGS. 3A, 3B and 3C, which are explanatory diagrams for describing the abutting and separating operation of the conveying unit 320. FIG. 3A shows the state in which the rollers of the conveying unit 320 abut. FIGS. 3B and 3C show state in which the rollers of the conveying unit 320 are separated from each other.

The registration unit 300 has the unit driving motor M4 as a driving portion that switches the position of the conveying unit 320 and the position detecting sensor S3 as a detecting member that detects the position of the conveying unit 320. The unit driving motor M4 moves the conveying unit 320 (pre-registration guide 322) to switch the positions of the upper pre-registration roller 321U such that the upper pre-registration roller 321U abuts on the lower pre-registration roller 321L or the upper pre-registration roller 321U is separated from the lower pre-registration roller 321L. In this embodiment, a detecting flag that detects the amount of rotation of the conveying unit 320 and the position detecting sensor S3 are exemplified as a detecting member. However, the invention is not limited to this configuration.

As described above, the upper pre-registration roller 321U and the pre-registration guide 322 of the conveying unit 320 integrally rotate around the rotation center 320C. The conveying unit 320 is driven to rotate by the unit driving motor M4 (see FIG. 8). The position of the conveying unit 320 is detected by the detecting flag that detects the rotation amount of the conveying unit 320 and the position detecting sensor S3. Accordingly, the control portion 170, which will be described later can freely control the position of the conveying unit 320 based on the rotation amount detected by the position detecting sensor S3.

In this embodiment, the position of the conveying unit 320 can be switched to the first position shown in FIG. 3A, the second position shown in FIG. 3B and the third position shown in FIG. 3C by the control portion 170 based on the rotation amount detected by the position detecting sensor S3. The first position shown in FIG. 3A is an abutting position where the upper pre-registration roller 321U abuts on the lower pre-registration roller 321L. The second position shown in FIG. 3B is a first separating position where the upper pre-registration roller 321U is separated from the lower pre-registration roller 321L. The third position shown in FIG. 3C is a second separating position where the upper pre-registration roller 321U is further separated from the lower pre-registration roller 321L so that the distance between the upper and lower pre-registration rollers 321U and the 321L is wider than in the second position.

The control portion 170, which will be described later can control the conveying unit 320 to rotate in synchronism with the timing when the vertical path sensor S1 and the pre-registration sensor S2 detect a sheet. As a result, the operation of the upper re-registration roller 321U abutting on or being separated from the lower pre-registration roller 321L can be performed sequentially even during the conveyance of a sheet.

Figure 4A:
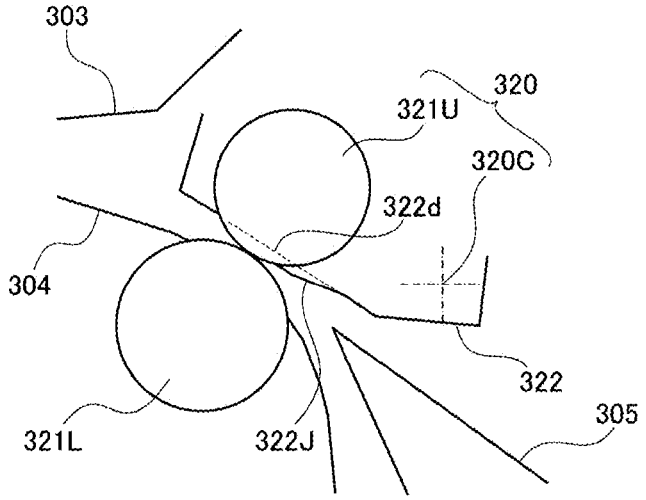
FIGS. 4A and 4B are explanatory diagram showing a jump ramp of a pre-registration guide.
Figure 4B:
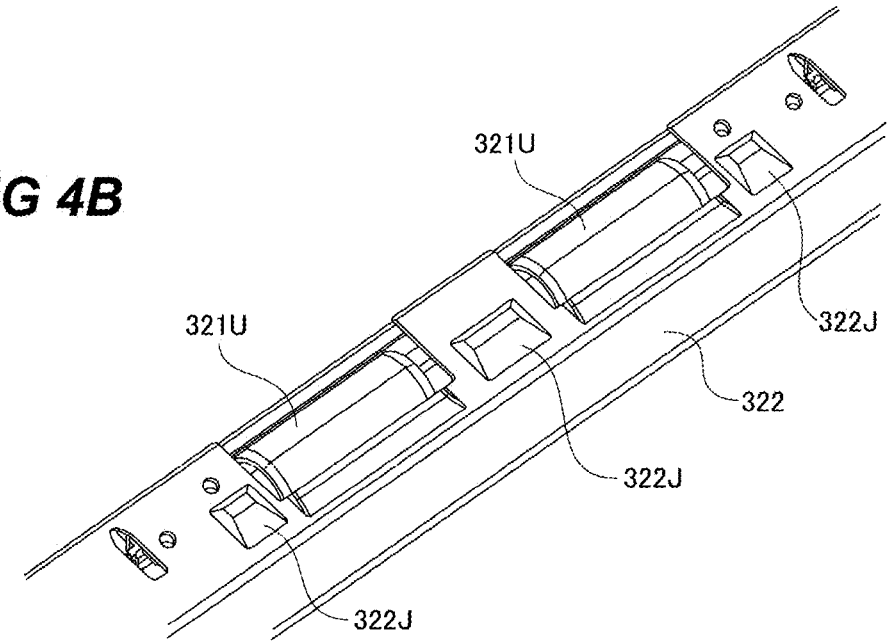

Next, the jump ramp 322J of the pre-registration guide 322 will be described referring to FIGS. 4A and 4B, which are explanatory diagrams of the jump ramp 322J of the pre-registration guide 322. FIG. 4A is a diagram showing a cross-section of the jump ramp 322J of the pre-registration guide 322. FIG. 4B is a diagram showing a perspective view of the jump ramp 322J of the pre-registration guide 322.

The pre-registration guide 322 has the jump ramp 322J as a protruding portion that guides the tip of a sheet to the upper pre-registration roller 321U. The jump ramp 322J is used for suppressing an end portion turning up of the tip of a sheet which is generated by the sheet tip abutting against the upper pre-registration roller 321U.

The jump ramp 322J is provided to protrude from the upper pre-registration roller 321U side to the lower pre-registration roller 321L that is opposed to the upper pre-registration roller 321U. The jump ramp 322J has a slope that approaches the lower pre-registration roller 321L as going in the direction from the upstream side to the downstream side of the conveying direction. With this configuration, the abutting angle of a sheet tip to the upper pre-registration roller 321U becomes small (when an acute angle is taken as the abutting angle), so that end portion turning up of a sheet tip can be avoided.

The broken line 322*d* shown in FIG. 4A indicates a guide surface without a jump ramp. The jump ramp 322J protrudes toward the conveying surface side from the this guide surface (broken line 332*d*). The jump ramp 322J does not occupy the entire region in the width direction that is perpendicular to the sheet conveying direction, but occupies a part of the region in the pre-registration guide 322 as shown in FIG. 4B.

When a super-thick sheet such as a sheet with 500 g passes with the conveying unit 320 closed, the abutting pressure to the jump ramp 322J becomes partially high. As a result, conveying scratches and dark spots may be generated.

Next, the basic operation of making a loop of a sheet to correct the skew feeding at the registration unit 300 will be described referring to FIGS. 5 to 7. The operation of the correction of the skew-feeding of a sheet with low stiffness such as a sheet of plain paper will be described referring to FIGS. 5A and 5B and the operation of the correction of the skew feeding of a sheet with high stiffness such as a sheet of thick paper will be described referring to FIGS. 6A, 6B, and 7.

Figure 5A:
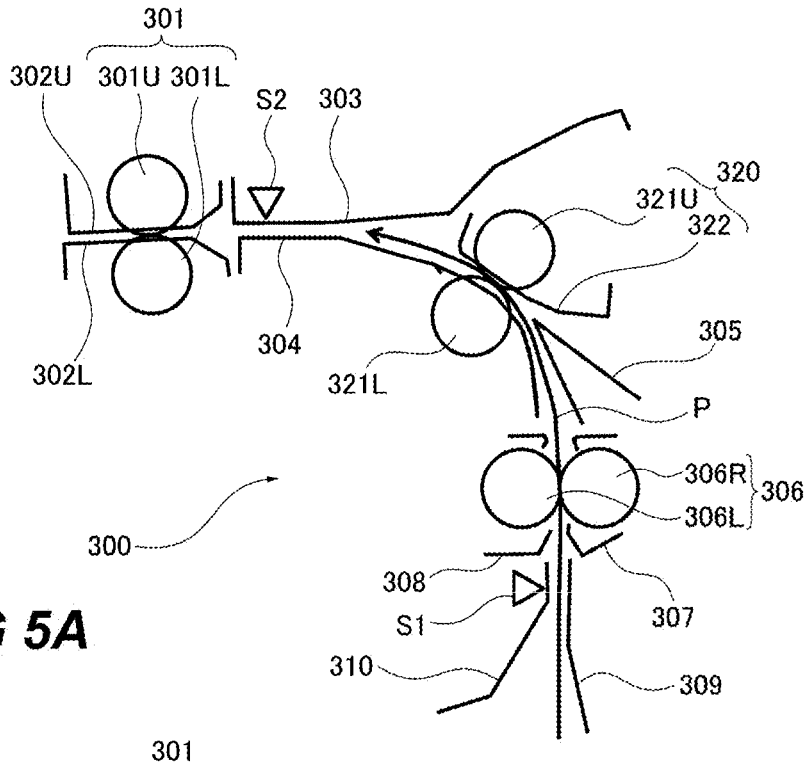
FIGS. 5A and 5B are explanatory diagrams showing correction of skew feeding of a sheet of plain paper.
Figure 5B:
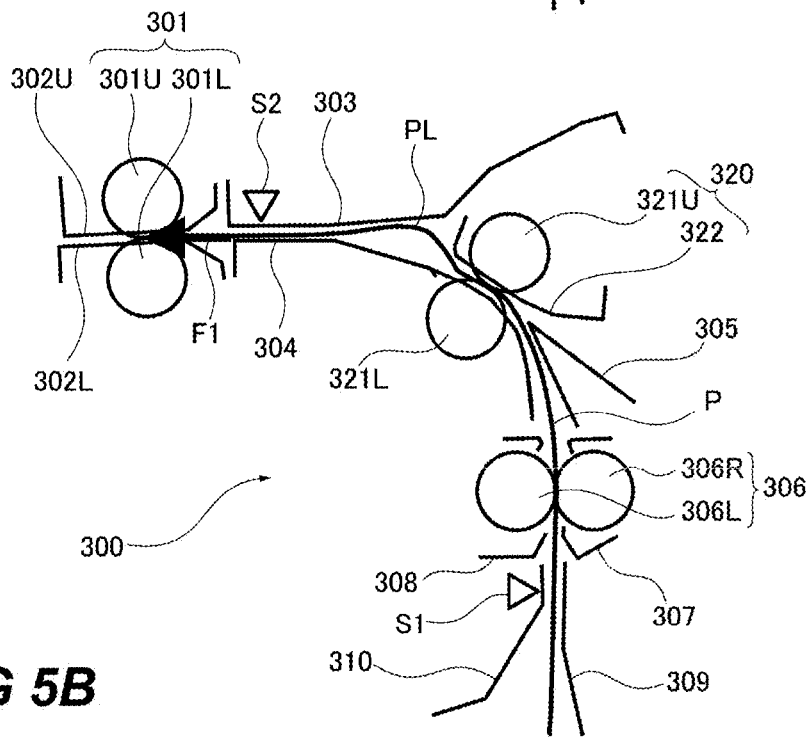

In the case of a sheet with low stiffness, the conveying unit 320 receives a sheet tip at the first position in which the upper pre-registration roller 321U abuts against the lower pre-registration roller 321L as shown in FIG. 5A. Thereafter, the loop PL is formed on the sheet P by the pre-registration roller 321 feeding the sheet P for a predetermined amount with the registration roller 301 stopped as shown in FIG. 5B. When the loop PL is formed, the stiffness of the sheet P generates the abutting force F1 to the registration roller 301 so that the sheet tip abuts against the nip portion of the registration roller 301. As a result, the sheet P fed being skewed follows the nip portion of the registration rollers 301 and the skew feeding of a sheet is corrected. In order to correct the skew properly by the sheet tip properly abutting against the registration roller 301, it is important to adjust the force F1 with which the sheet tip abuts against the registration roller 301. When the force F1 is too small, the sheet tip does not fully abuts against the registration rollers 301 so that some skew feeding remains. In contrast, when the force F1 is too large, damage such as a bend mark produces.

Figure 6A:
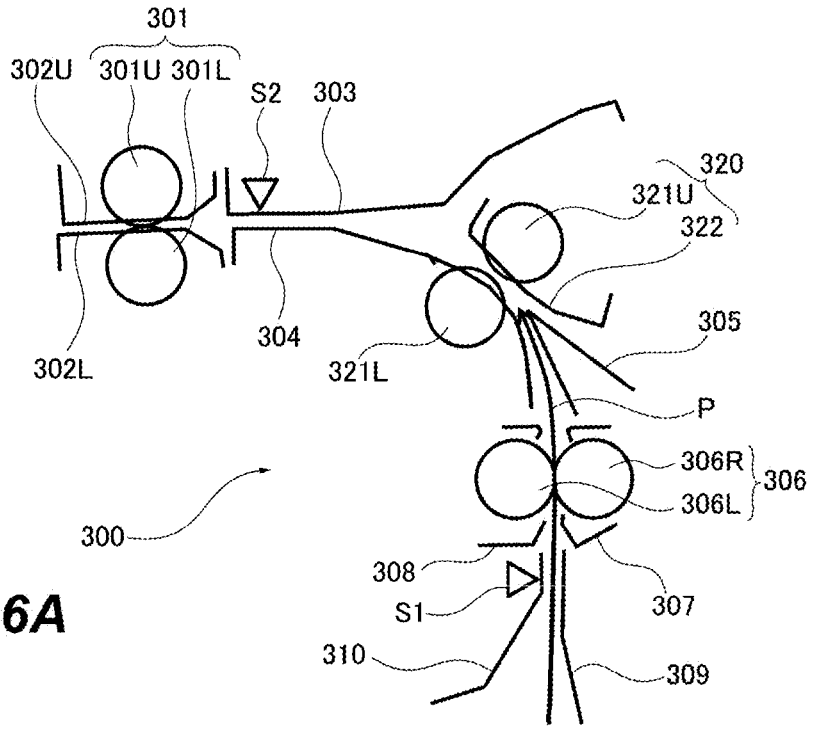
FIGS. 6A and 6B are explanatory diagrams showing correction of skew feeding of a sheet of thick paper.

In contrast, in the case of a sheet with high stiffness, the conveying unit 320 receives a sheet tip at the second position in which the upper pre-registration roller 321U is separated from the lower pre-registration roller 321L as shown in FIG. 6A. Thereafter, the conveying unit 320 shifts to the third position in which the upper pre-registration roller 321U is further separated from the lower pre-registration roller 321L so that the space between the roller 321U and the roller 321L more widely opened than in the second position before the sheet tip arrives at the registration rollers 301 as shown in FIG. 6B. Thereafter, as shown in FIG. 7, the sheet tip abuts against the registration rollers 301 to generate an abutting force F2 so that the loop PL is formed on the sheet. As a result, the skew feeing of a sheet is corrected.

Since a sheet of plain paper has a stiffness lower than that of a sheet of thick paper, it is desirable to form a loop PL on a sheet of plain paper with the conveying unit 320 closed to generate a predetermined abutting force F1. In contrast, when a loop PL is formed on a sheet of thick paper whose stiffness is higher than that of a sheet of plain paper with the conveying unit 320 closed, the roller pressure gives in to the reactive force of the sheet of thick paper so that a problem occurs such as generation of slip marks. Therefore, it is desirable to form a loop on a sheet of thick paper in the state where a loop forming space (space between the roller 321U and the roller 321L) that is larger than that in the second position is maintained after shifting the conveying unit 320 to the third position. By receiving a sheet tip in the state where the conveying unit 320 is shifted to the second position, dark spots can be avoided which are generated by an abutting pressure against the jump ramp 322J being partially made higher.

As described above, by controlling the position of the conveying unit 320 according to the sheet stiffness (sheet basis weight), all of the correction of skew feeding of a sheet of plain paper, the correction of skew feeding and the avoidance of slip marks of a sheet of thick paper, and the avoidance of dark spots can be properly realized.

Figure 9:
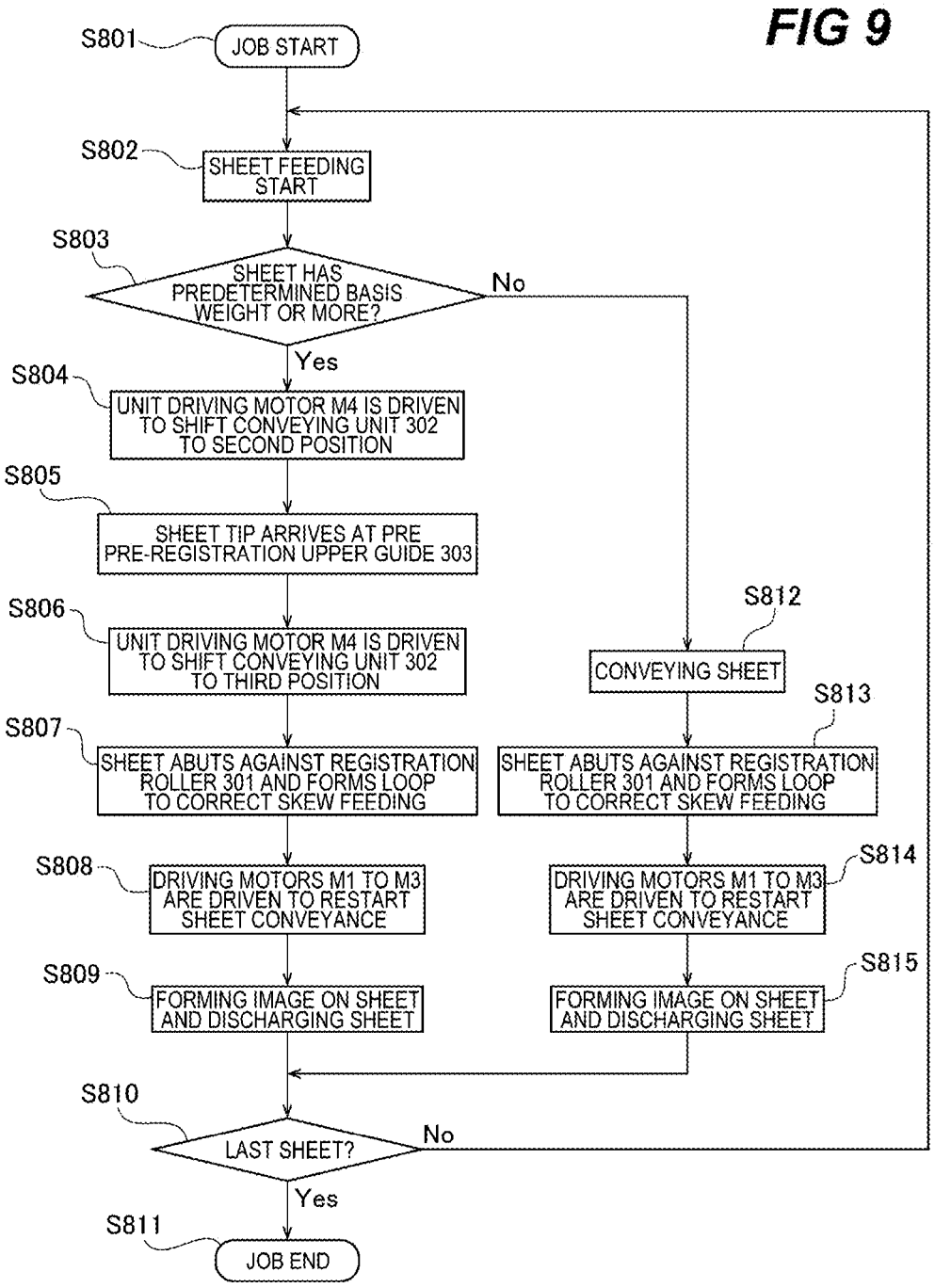
FIG. 9 is a flowchart showing the flow of the sheet conveying operation during image formation.

Next, the image forming operation and the sheet conveying operation can be described referring to the block diagram of FIG. 8 and the flowchart of FIG. 9. FIG. 8 is a block diagram of the image forming apparatus. FIG. 9 is a flowchart showing a flow of sheet conveying operation during image forming.

As shown in FIG. 8, the image forming apparatus 100 has the control portion 170 that controls the entire operation of the image forming apparatus. The control portion 170 has the CPU 171, the memory 172, the I/O port 173, the communication interface 174, and the timer 175. The CPU 171 performs an overall control operation such as an image processing control and a printing control based on the programs stored in the memory 172. The memory 172 stores programs and data necessary for various operations by the CPU 171 and operates as a working area.

The control portion 170 receives signals from the vertical path sensor S1, the pre-registration sensor S2, and the position detecting sensor S3. Further, the control portion 170 receives an image forming job from an external device. Furthermore, the control portion 170 accepts inputs of various settings and operational instructions from a user via the operation portion 210. In the present embodiment, the control portion 170 switches the position of the conveying unit 320 according to the basis weight of a sheet included in the information from the operation portion 210.

The control portion 170 controls the operations of the feeding portion 110, the image forming portion 920, the vertical path roller driving motor M1, the pre-registration driving motor M2, the registration roller driving motor M3, and the unit driving motor M4 according to received signals and so on.

Next, a flow of the sheet conveying operation during image forming will be described referring to FIGS. 8 and 9. After a user inputs information about a size and a basis weight of a sheet from the operation portion 210, a job starts (step S801). When the job starts, the feeding of a sheet from the feeding portion 110 starts (step S802).

When the feeding of the sheet starts, the control portion 170 determines whether the basis weight of the sheet used for the job is equal to or greater than a determined amount of basis weight (step S803). When the sheet is a first sheet with a basis weight less than the predetermined basis weight, the sequence proceeds to the step S804. In contrast, when the sheet is a second sheet with the predetermined basis weight or more, the sequence proceeds to the step S812. In the present embodiment, the second sheet with the predetermined basis weight or more is exemplified as a sheet of thick paper with basis weight of 151 gsm or more. In contrast, the first sheet with a basis weight less than the predetermined basis weigh is exemplified as a sheet of plain paper (or thin paper) with 150 gsm or less, which has a stiffness less than a sheet of thick paper. The types and basis weights of the respective sheets are examples and the invention is not limited to these specifications.

When the sheet has the predetermined basis weight or more (for example a sheet of thick paper) at the step S803, the conveying unit 320 receives the sheet tip with the conveying unit 320 open. Namely, before the sheet tip arrives at the nip portion of the pre-registration roller 321 of the conveying unit 320, the conveying unit 320 shifts to the second position indicated in the FIG. 6A. Specifically, when the sheet tip is conveyed for the predetermined distance after the vertical path sensor S1 detects the sheet tip, the unit driving motor M4 is driven and the conveying unit 320 shifts to the second position indicated in FIG. 6A and stands by (step S804). This predetermined distance is obtained by the calculation of the CPU 171 based on the predetermined number of pulses for which the vertical path roller driving motor M1 rotates after the vertical path sensor S1 detects the sheet tip. The calculation of the predetermined distance in the following description is performed in the same way as above.

Further, the timing when the conveying unit 320 shifts to the second position at the step S804 is not limited to a point of time when the sheet tip is conveyed for the predetermined distance after the vertical path sensor S1 detects the sheet tip. For example, the conveying unit 320 may be configured to shift to the second position immediately after the vertical path sensor S1 detects the sheet tip.

Figure 6B:
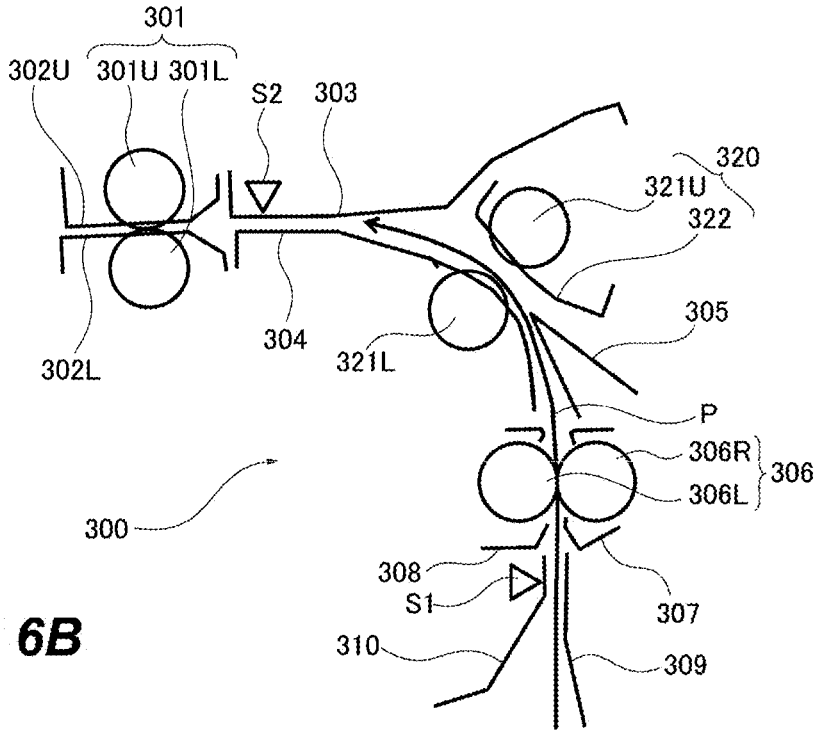
Figure 7:
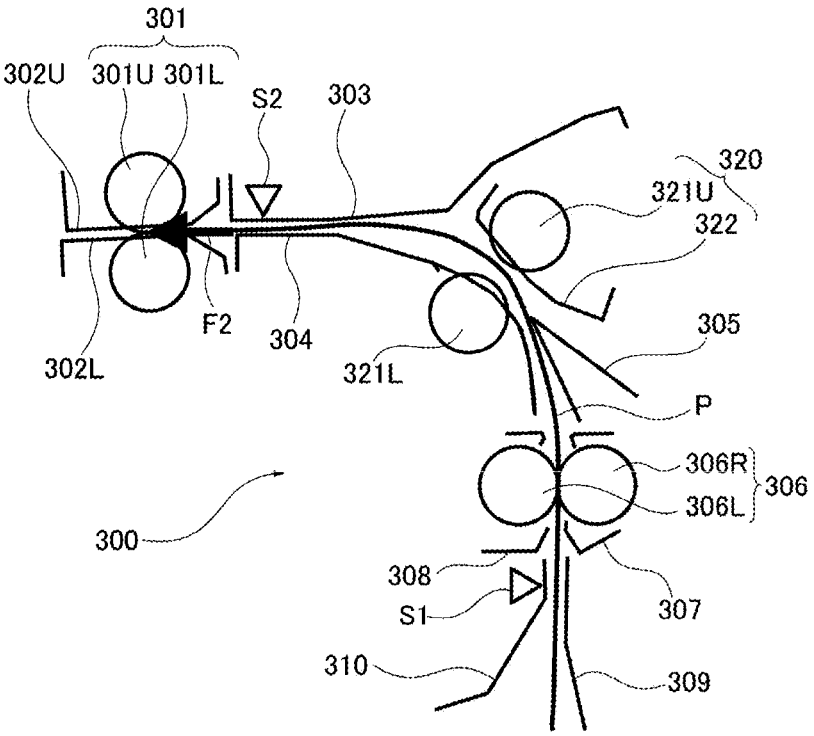
FIG. 7 is an explanatory diagram showing correction of skew feeding of a sheet of thick paper.

After the sheet tip is passed on to the conveying unit 320 in the second position and before the sheet tip abuts against the registration rollers 301, the unit driving motor M4 is driven again and the conveying unit 320 shifts to the third position indicated in FIG. 6B (step S806). Specifically, when the sheet tip passes through the conveying unit 320 for the predetermined distance and arrives at the pre-registration upper guide 303 (step S805), the unit driving motor M4 is driven again and the conveying unit 320 shifts to the third position indicated in FIG. 6B (step S806). For example, when the sheet is fed for a predetermined amount after the vertical path sensor S1 detects the sheet tip, the conveying unit 320 shifts to the third position.

By shifting the conveying unit 320 to the third position, the space between the roller 321U and the roller 321L is opened wider than in the second position. With this state, the tip of the sheet P abuts against the nip portion of the registration rollers 301 to form a predetermined amount of loop on the sheet P so that the skew feeding of the sheet P is corrected (step S807). Thereafter, the driving motors M1 to M3 are driven to restart the conveyance of the sheet (step S808), the sheet is conveyed to the secondary transfer portion 130 and the fixing portion 50 to form an image, and the sheet is conveyed to the post-conveying portion 903 to discharge the sheet (step S809). The similar operation is repeated until the last sheet of the job and the job ends (steps S810, S811).

In contrast, when the sheet has the basis weight less than the predetermined basis weight (for example, a sheet of plain paper and thin paper) in the step S803, the conveying unit 320 receives the sheet tip with the conveying unit 320 closed. Namely, the conveying unit 320 stands by in the first position indicated in the FIG. 5A and the conveying unit 320 receives the sheet tip with the pre-registration rollers 321 abutting on each other. With this state, the tip of the sheet P abuts against the nip portion of the registration rollers 301 to form a predetermined amount of loop as shown in FIG. 5B to correct the skew feeding of the sheet P (step S813). Thereafter the sheet conveyance is restarted (step S814), the image formation and discharge are performed (step S815) until the last sheet and the job is completed (steps S810, 811).

As described above, by controlling the position of the conveying unit 320 according to the basis weight of the sheet, turning up of the sheet with the basis weight less than the predetermined basis weight, slip marks and dark spots on the sheet with predetermined basis weight or more can be avoided as well as suppressing insufficient skew feeding correction of the sheet.

The above described embodiment is exemplified as a color image forming apparatus with four image forming stations. However, the invention is not limited to this configuration and can be applied to an image forming apparatus having one image forming station.

The above described embodiment is exemplifies as an image forming apparatus in which an intermediate transfer belt is used and the respective color toner images are transferred in a sequentially superimposed manner, and the respective color toner images borne on the intermediate transfer belt are transferred to the sheet in a batch. However, the present invention is not limited to this configuration and can be applied to an image forming apparatus in which a sheet bearing member is used and respective color toner images are transferred to the sheet borne on the sheet bearing member in a sequentially superimposed manner. In these cases, the same effect can be also obtained.

Further, the recording system of the above described embodiment is exemplified as an electrophotographic system. However, the invention is not limited to this configuration and another recording systems such as an ink jet system can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-115645, filed Jul. 14, 2023, which is hereby incorporated by reference herein in its entirety.

What is claimed is:

1. A sheet conveying apparatus having a first conveying roller pair configured to nip and convey a sheet, and a second conveying roller pair provided upstream of the first conveying roller pair in a sheet conveying direction, the second conveying roller pair being configured to nip and convey the sheet, the sheet conveying apparatus being configured to correct skew feeding of the sheet by a tip of the sheet abutting against a nip portion of the first conveying roller pair, the sheet conveying apparatus comprising:

a conveying unit having a third conveying roller that conveys the sheet, and a guide member that guides the sheet, the third conveying roller being provided between the first conveying roller pair and the second conveying roller pair, the guide member being configured to support the third conveying roller and to be rotatable, the conveying unit being configured to shift along with the guide member to an abutting position where the third conveying roller abuts on a counter roller or a separating position where the third conveying roller is separated from the counter roller;

a driving portion configured to switch a position of the conveying unit to the abutting position and the separating position;

a detecting member configured to detect the position of the conveying unit; and a control portion configured to switch the position of the conveying unit according to a basis weight of the sheet, wherein when a first sheet with a predetermined basis weight is conveyed, the control portion performs such a control that the third conveying roller is located in the abutting position and a tip of the first sheet is guided along the guide member to a nip portion between the third conveying roller and the counter roller with the third conveying roller being located in the abutting position, and wherein when a second sheet with a basis weight greater than that of the first sheet is conveyed, the control portion performs such a control that the third conveying roller is located in the separating position and a tip of the second sheet is guided along the guide member with the third conveying roller being located in the separating position.

2. The sheet conveying apparatus according to claim 1, wherein given that the separating position is a first separating position, the conveying unit is configured to be able to shift to a second separating position where the counter roller is further separated from the third conveying roller than in the first separating position, wherein when the first sheet is conveyed, the control portion performs such a control that the tip of the first sheet is guided along the guide member to the nip portion between the third conveying roller and the counter roller with the third conveying roller being located in the abutting position, and the first sheet abuts against the nip portion of the first conveying roller pair by means of the third conveying roller that abuts on the counter roller so that skew feeding of the first sheet is corrected, and wherein when the second sheet is conveyed, the control portion performs such a control that with the third conveying roller being located in the first separating position, the tip of the second sheet is guided along the guide member, the driving portion shifts the conveying unit from the first separating position to the second separating position before the tip of the second sheet abuts against the nip portion of the first conveying roller pair, and the second sheet abuts against the nip portion of the first conveying roller pair by means of the second conveying roller pair so that skew feeding of the second sheet is corrected.

3. The sheet conveying apparatus according to claim 1, wherein the guide member forms a curved conveying path that guides the sheet in the conveying unit and is disposed on an outer side of the curved conveying path.

4. The sheet conveying apparatus according to claim 1, wherein the guide member includes a protruding portion that guides the tip of the sheet to the third conveying roller.

5. The sheet conveying apparatus according to claim 4, wherein the protruding portion is disposed not to fully occupy a region in a width direction perpendicular to the sheet conveying direction but to partially occupy the region in the guide member.

6. The sheet conveying apparatus according to claim 1, wherein the detecting member detects an amount of rotation of the conveying unit, and wherein the control portion can freely control the position of the conveying unit based on the amount of rotation detected by the detecting member.

7. An image forming apparatus comprising:

the sheet conveying apparatus according to claim 1; and an image forming portion configured to form an image on the sheet conveyed by the sheet conveying apparatus.

* * * * *